United States Patent [19]

Eppink

[11] Patent Number: 4,679,638

[45] **Date of Patent: * Jul. 14, 1987**

[54] DOWNHOLE PROGRESSIVE CAVITY TYPE DRILLING MOTOR WITH FLEXIBLE CONNECTING ROD

[75] Inventor: Jay M. Eppink, Spring, Tex.

[73] Assignee: Hughes Tool Company, Houston, Tex.

[ * ] Notice: The portion of the term of this patent subsequent to Jan. 13, 2004 has been disclaimed.

[21] Appl. No.: 814,335

[22] Filed: Dec. 27, 1985

Related U.S. Application Data

[63] Continuation-in-part of Ser. No. 711,322, Mar. 13, 1985, Pat. No. 4,636,151.

[51] Int. Cl.[4] ..... E21B 4/02; F03C 2/00; F16D 3/04

[52] U.S. Cl. ..... 175/107; 418/48; 418/182; 464/19; 464/97; 464/160

[58] Field of Search ..... 175/107, 106, 101; 464/19, 97, 160, 78, 153, 147; 418/48, 182

[56] References Cited

U.S. PATENT DOCUMENTS

| | | | |
|---|---|---|---|
| 2,028,407 | 1/1936 | Moineau | 418/48 |
| 2,346,426 | 4/1944 | Hait | 418/182 |
| 2,621,605 | 12/1952 | Mark, Jr. | 418/48 |
| 3,142,973 | 8/1964 | Evans et al. | 64/27 |
| 3,155,187 | 11/1964 | De Lorean | 464/97 |
| 3,340,814 | 9/1967 | Streicher | 418/48 |
| 3,399,549 | 9/1968 | Nagele | 64/23 |
| 3,408,830 | 11/1968 | Sutanik et al. | 464/97 |
| 3,600,113 | 8/1971 | Pahl et al. | 418/48 |
| 3,612,734 | 10/1971 | Dawson et al. | 418/48 |
| 3,894,818 | 7/1975 | Tschirky | 418/48 |
| 3,939,670 | 2/1976 | Amtsberg | 64/27 B |
| 4,080,115 | 3/1978 | Sims et al. | 418/48 |
| 4,140,444 | 2/1979 | Allen | 418/48 |
| 4,151,728 | 5/1979 | Kimball | 464/97 |
| 4,187,918 | 2/1980 | Clark | 175/39 |
| 4,192,155 | 3/1980 | Gray | 64/23 |
| 4,263,788 | 4/1981 | Beimgraber | 464/147 |
| 4,449,953 | 5/1984 | Nikomarov et al. | 464/19 |

FOREIGN PATENT DOCUMENTS

| | | | |
|---|---|---|---|
| 2945858 | 7/1980 | Fed. Rep. of Germany | 418/182 |
| 2084697 | 4/1982 | United Kingdom | 418/48 |
| 2152588 | 8/1985 | United Kingdom | 418/48 |

*Primary Examiner*—James A. Leppink
*Assistant Examiner*—Hoang C. Dang
*Attorney, Agent, or Firm*—H. Dennis Kelly

[57] ABSTRACT

A downhole motor has a rotor and a stator, of the progressive cavity type, inside a housing. A bearing shaft is mounted within the housing, with a bearing between the housing and the bearing shaft, and the bearing shaft is rotatable about the longitudinal axis of the bearing shaft and the housing. A flexible rod, with a connection on each end, extends between the rotor and the bearing shaft, for translating the rotation and gyration of the rotor to the true rotation of the bearing shaft. A cylindrical overload sub is located concentrically around the rod. A plurality of splines and slots on the connections engage a plurality of splines and slots on the sub to allow the connections to rotate axially a limited amount in relation to one another. Teeth may be used instead of splines and slots.

10 Claims, 5 Drawing Figures

DOWNHOLE PROGRESSIVE CAVITY TYPE DRILLING MOTOR WITH FLEXIBLE CONNECTING ROD

This application is a continuation-in-part of application Ser. No. 711,322, filed Mar. 13, 1985, now U.S. Pat. No. 4,636,151, issued Jan. 13, 1987.

BACKGROUND OF THE INVENTION

1. Field of the Invention

This invention relates in general to downhole drilling motors, and in particular to downhole drilling motors of the progressive cavity type.

2. Description of the Prior Art

Downhole drilling motors have been used for many years in the drilling of oil and gas wells. Usually, the bearing shaft of the motor, and the drill bit, will rotate with respect to the housing of the drilling motor. The housing is connected to the bottom of a conventional drill string, made up of drill collars and sections of drill pipe. At the surface, the drill string is connected to a kelly, which is mounted in the rotary table of a drilling rig.

Drilling fluid, or "mud," is pumped through the drill string to the bottom of the hole, and returns up the annulus between the drill string and the wall of the borehole. The mud cools the drilling tools and removes the cuttings from the hole. If the downhole drilling motor is hydraulic, the mud also supplies the hydraulic power to operate the motor.

One type of hydraulic downhole motor is the progressive cavity type, also known as the Moineau motor. This type of motor has a helical rotor within the cavity of a stator, and the stator is connected to a housing. As mud is pumped through the stator, the rotor is rotated. As the rotor rotates, it also gyrates, or orbits, in the reverse direction relative to its rotation. A universal connection must be used to connect the gyrating rotor to the bearing shaft of the motor, because the bearing shaft does not gyrate.

One type of connector has universal joints, which connect the ends of a straight rod to the rotor and to the bearing shaft. The universal joints take only torsional load, so a ball and race assembly is used to take the thrust load. Rubber boots are clamped over the universal joints to keep mud out of the ball and race assembly.

There are problems with rubber boot systems. Boots may loosen or come off, allowing mud to enter and wear out the ball and race assembly. The universal joints then must also take thrust loads, causing early failure of the universal joints. Most universal connectors also require oil reservoir systems to lubricate the ball race and the universal joints.

Other downhole motors have long, flexible connecting rods, which flex to compensate for the gyration of the rotor. Such connecting rods must be able to bear both thrust loads and torque loads. The rods must also be flexible enough to allow the eccentricity between the rotor and the bearing shaft, with a reasonably small side load. A one piece connecting rod, or a rod assembly, that has the required flexibility, also has torsional flexibility. That helps the motor run smoothly when dynamic external torques are encountered.

Occasionally excessive torque loads will cause a connecting rod to fail. A need existed for a connecting rod which is flexible, but which will not fail under excessive torque loads.

SUMMARY OF THE INVENTION

In a downhole drilling motor of the progressive cavity type, the rotor is connected to the bearing shaft by a connecting rod assembly. An upper connection is attached to one end of a flexible rod, for connecting the rod to the motor. A lower connection is attached to the other end of the rod, for connecting the rod to the bearing shaft.

A cylindrical overload sub is located around the rod. Several splines and slots, on the sub, engage splines and slots on the connections. The slots are wider than the splines, so the connections can rotate a certain amount relative to one another.

The rod takes the torsional load, until the torque on the connections reaches a certain level. Then, the splines reach the sides of the slots. The sub then takes the torsional load, rather than the rod. Therefore, the overload sub prevents an excessive torque from being applied to the flexible rod. Teeth, on each end of the sub, and on the connections, could be used instead of splines and slots.

DESCRIPTION OF THE PREFERRED EMBODIMENT

Figure 1A:
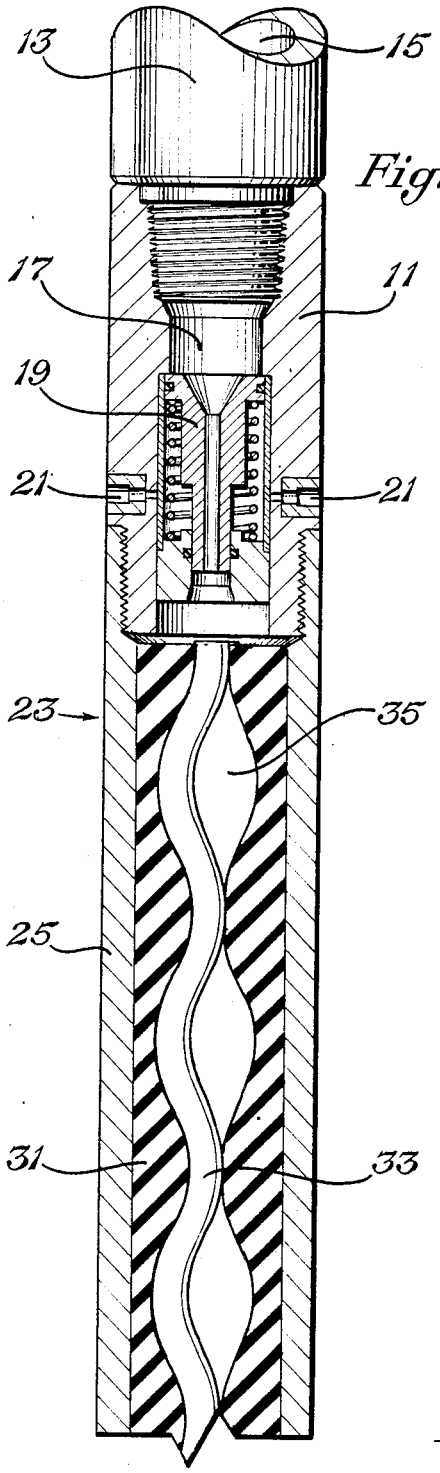
FIGS. 1A, 1B and 1C are sectional views, from top to bottom, of a drilling motor according to the invention.

Referring first to FIG. 1A, a bypass valve 11 is connected to the lower end of a drill string 13. The drill string 13 consists of drill collars and sections of drill pipe, and extends upward to a drilling rig at the surface. Drilling fluid, or "mud," is pumped through the bore 15 of the drill string 13 into the bore 17 of the bypass valve 11.

The mud forces a shuttle 19 downward to close off some bypass ports 21. When the bypass ports 21 are open, mud can escape from the bore 15 of the drill string 13 while the drill string 13 is being removed from the hole. Mud can enter the bore 15 of the drill string 13, through the bypass ports 21, when the drill string is put into the hole. When the bypass ports 21 are closed by the shuttle 19, the mud is directed downward into a downhole drilling motor 23.

The housing of the downhole drilling motor 23 has three parts: an upper housing 25, a connecting rod housing 27, and a bearing housing 29. The cylindrical upper housing 25 is connected to the lower end of the bypass valve 11, and houses a progressive cavity motor. The progressive cavity motor has a flexible stator 31, which is connected to the inner surface of the upper housing 25. A helical rotor 33 is mounted within the stator 31. As mud flows downward through the cavities 35 between the stator 31 and the rotor 33, fluid pressure causes the rotor 33 to rotate.

Figure 1B:
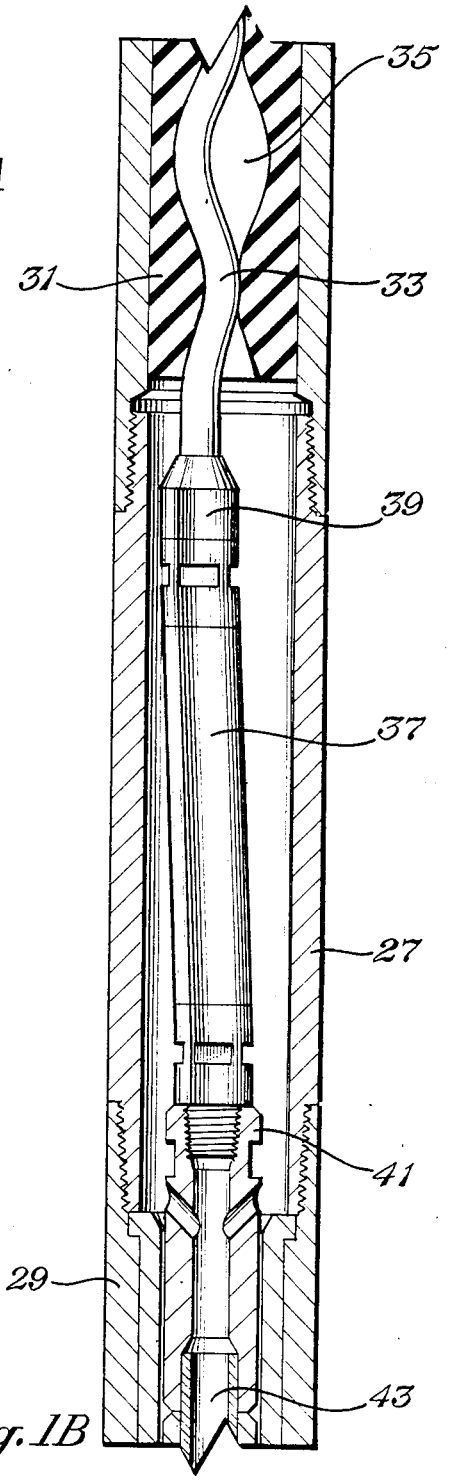

As the rotor 33 rotates, it also gyrates, or orbits in the reverse direction. As shown in FIG. 1B, a connecting rod assembly 37 connects the lower end 39 of the rotor 33 to a rotating shaft cap 41, which is firmly secured to a rotating bearing shaft 43. The connecting rod assembly 37 must be flexible enough to translate the gyrating motion of the rotor 33 to the true rotation of the bearing shaft 43.

The connecting rod housing 27 is connected to the lower end of the upper housing 25, and encloses the connecting rod assembly 37. The bearing housing 29 is connected to the lower end of the connecting rod housing 27, and completes the housing of the drilling motor 23. The bearing shaft 43 is mounted concentrically within the bearing housing 29.

Figure 1C:
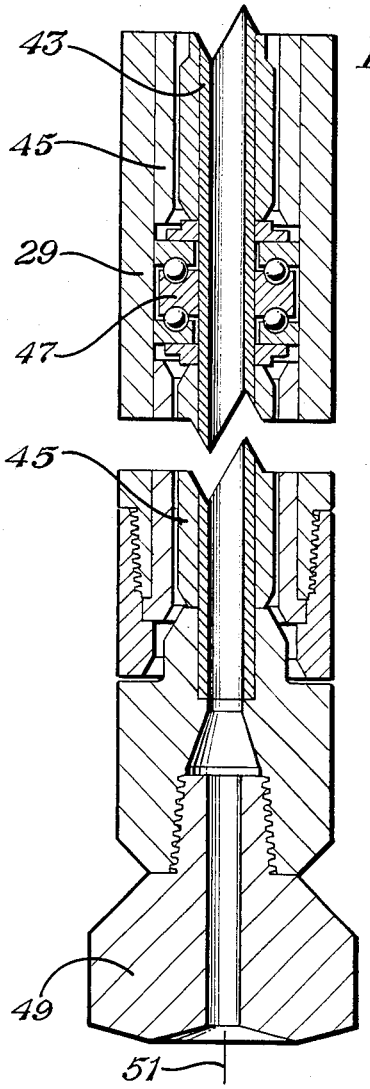

The lower end of the drilling motor 23 is shown in FIG. 1C. Various radial bearings 45 and thrust bearings 47 transmit loads between the rotating bearing shaft 43 and the bearing housing 29. A rock bit 49, which is threaded onto the bearing shaft 43, digs the borehole as it rotates. In order to drive the rock bit 49 properly, the bearing shaft 43 must rotate with a true rotation about the longitudinal axis 51 of the bearing shaft 43 and the housing 29.

Figure 2:
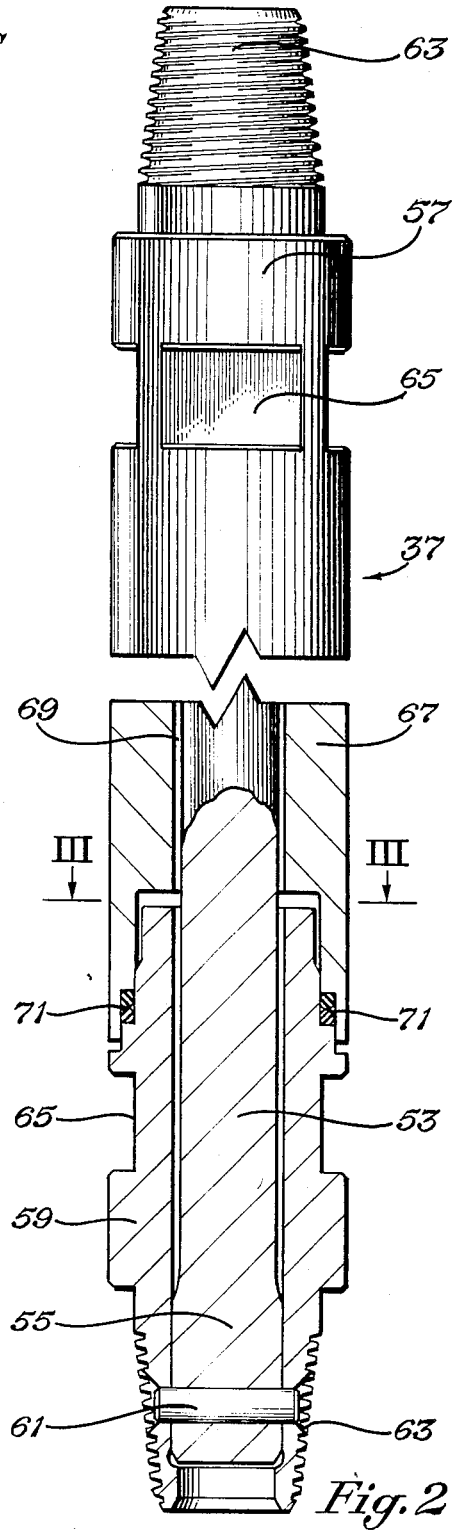
FIG. 2 is a side view, partially in section, of a connecting rod assembly according to the invention.

The connecting rod assembly 37 is shown in greater detail in FIG. 2. The connecting rod assembly 37 must translate the rotation and gyration of the rotor 33 to the true rotation of the bearing shaft 43. A flexible rod 53 extends from the lower end 39 of the rotor 33 to the bearing shaft cap 41 on top of the bearing shaft 43. The flexible rod 53 must withstand thrust and torque loads, and yet be flexible enough to allow for the eccentricity between the rotor 33 and the bearing shaft 43.

Each end of the flexible rod 53 has an upset section 55 to reduce stress at the ends, where bending loads are the highest. An upper connection 57 and a lower connection 59 are attached to the upset section 55 of the flexible rod 53. The connections 57, 59 may be secured to the rod 53 in any of several methods, including interference fit, threads, or pins 61, such as are shown in FIG. 2.

The connections 57, 59 have threads 63 for engaging the rotor 33 and the bearing shaft 43. The connection 57, 59 also have a plurality of machined flats 65 to facilitate assembly of the drilling motor 23.

A cylindrical overload sub 67 surrounds the connecting rod 53, and extends between the two connections 57, 59. The inner diameter of the overload sub 67 is larger than the diameter of the rod 53, leaving an annular space 69. A pair of o-ring seals 71 seal between the overload sub 67 and each of the connections 57, 59.

Figure 3:
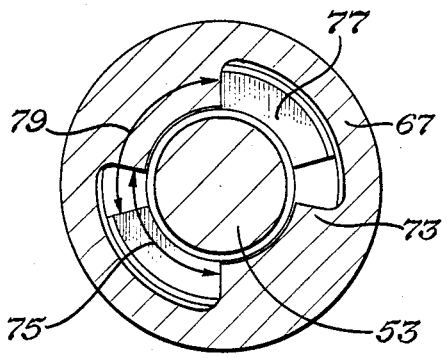
FIG. 3 is a cross-sectional view of a connecting rod assembly, as seen along lines III—III in FIG. 2.

The overload sub 67 has several splines 73 and slots 75 at each end, as shown in FIG. 3. These splines 73 and slots 75 engage several splines 77 and slots 79 on the connections 57, 59. On at least one end of the sub 67, the slots 75, 79, are wider than the respective splines 73, 77, as shown in FIG. 3. This allows the connections 57, 59 to rotate axially a limited amount relative to one another. The splines 73, 77 and slots 75, 79 at the other end of the sub 67 may D be the same size, or the slots 75, 79 may be wider than the splines 73, 77.

The splines 73, 77 and slots 75, 79 are thus a means for engaging the sub 67 and the connections 57, 59 in a manner so as to allow the connections 57, 59 to rotate axially a limited amount in relation to one another. Another means for engaging the sub 67 and the connections 57, 59 in such a manner might include teeth, on the ends of the sub 67, which engage teeth on the ends of the connections 57, 59.

Since the ends of the connecting rod 53 are connected to the two connections 57, 59, the connecting rod 53 takes the torsional load, until the torque on the connections 57, 59 reaches a certain level. Then, the splines 73, 77 reach the sides of the slots 75, 79. The sub 67 then takes the additional torsional load, rather than the rod 53. The overload sub 67 thus places a limit on the amount of torque to which the connecting rod 53 can be subjected.

During operation, mud circulates through the drilling motor 23 to rotate the rotor 33. As the rotor 33 rotates the lower end 39 of the rotor 33 also gyrates. The connecting rod assembly 37 must translate the rotation and gyration of the rotor 33 to the true rotation of the bearing shaft 43. The flexible rod 53 bends and flexes to compensate for the eccentricity between the rotor 33 and the bearing shaft 43.

The connecting rod 53 is also subjected to torsional forces. A predetermined amount of twisting is allowed before the splines 73, 77 and the slots 75, 79 prevent further rotation. Any additional torque load is borne by the overload sub 67, rather than by the connecting rod 53.

The downhole drilling motor 23 of the invention has several advantages over the prior art. The overload sub 67 bears any excessive torque, rather than the connecting rod 53. Therefore, the rod 53 is protected from excessive torque and premature failure.

The invention has been shown in only one embodiment. It should be apparent to those skilled in the art that the invention is not so limited, but is susceptible to various changes and modifications without departing from the spirit thereof.

I claim:

1. A downhole drilling motor, comprising:

a stator of the progressive cavity type;

a rotor, within the stator, wherein the rotor rotates and gyrates in response to fluid flow through the stator;

a housing, connected to the stator;

a bearing shaft, concentrically located within the housing, and rotatable about the longitudinal axis of the bearing shaft and the housing;

a bearing between the housing and the bearing shaft;

a flexible rod, extending between the rotor and the bearing shaft, for translating the rotation and gyration of the rotor to the true rotation of the bearing shaft;

an upper threaded connection, nonintegral to, but connected to one end of the rod, for connecting the rod to the rotor;

a lower threaded connection, nonintegral to, but connected to the other end of the rod, for connecting the rod to the bearing shaft;

a cylindrical overload sub, located concentrically around the rod; and means for engaging the sub and the selected connection in a manner so as to allow the connections to rotate axially a limited amount in relation to one another.

2. A downhole drilling motor, comprising:

a stator of the progressive cavity type;

a rotor, within the stator, wherein the rotor rotates and gyrates in response to fluid flow through the stator;

a housing, connected to the stator;

a bearing shaft, concentrically located within the housing, and rotatable about the longitudinal axis of the bearing shaft and the housing;

a bearing between the housing and the bearing shaft;

a flexible rod, extending between the rotor and the bearing shaft, for translating the rotation and gyration of the rotor to the true rotation of the bearing shaft;

an upper threaded connection, nonintegral to, but connected to the one end of the rod, for connecting the rod to the rotor;

a lower threaded connection, nonintegral to, but connected to other end of the rod, for connecting the rod to the bearing shaft;

a spline on a selected one of the connections; and a cylindrical overload sub, located concentrically around the rod, and having a slot on the end of the sub for engagement with the spline on the selected connection;

wherein the slot on the sub is wider than the spline on the selected connection, so that the connections can rotate axially a limited amount in relation to one another.

3. A downhole drilling motor, comprising:

a stator of the progressive cavity type;

a rotor, within the stator, wherein the rotor rotates and gyrates in response to fluid flow through the stator;

a housing, connected to the stator;

a bearing shaft, concentrically located within the housing, and rotatable about the longitudinal axis of the bearing shaft and the housing;

a bearing between the housing and the bearing shaft;

a flexible rod, extending between the rotor and the bearing shaft, for translating the rotation and gyration of the rotor to the true rotation of the bearing shaft;

an upper threaded connection, nonintegral to, but connected to one end of the rod, for connecting the rod to the rotor;

a lower threaded connection, nonintegral to, but connected to the other end of the rod, for connecting the rod to the bearing shaft, wherein a selected one of the connections has a slot;

a cylindrical overload sub, located concentrically around the rod; and a spline on one end of the sub, for engagement with the slot on the selected connection;

wherein the slot on the selected connection is wider than the spline on the sub, so that the connections can rotate axially a limited amount in relation to one another.

4. A downhole drilling motor, comprising:

a stator of the progressive cavity type;

a rotor, within the stator, wherein the rotor rotates and gyrates in response to fluid flow through the stator;

a housing, connected to the stator;

a bearing shaft, concentrically located within the housing, and rotatable about the longitudinal axis of the bearing shaft and the housing;

a bearing between the housing and the bearing shaft;

a flexible rod, extending between the rotor and the bearing shaft, for translating the rotation and gyration of the rotor to the true rotation of the bearing shaft;

an upper threaded connection, nonintegral to, but connected to one end of the rod, for connecting the rod to the rotor;

a lower threaded connection, nonintegral to, but connected to the other end of the rod, for connecting the rod to the bearing shaft;

a plurality of splines and slots on a selected one of the connections;

a cylindrical overload sub, located concentrically around the rod; and a plurality of splines and slots on one end of the sub, for engagement with the splines on the selected connection;

wherein the slots on the selected connection are wider than the splines on the sub, and the slots on the sub are wider than the splines on the selected connection, so that the connections can rotate axially a limited amount in relation to one another.

5. A downhole drilling motor, comprising:

a stator of the progressive cavity type;

a rotor, within the stator, wherein the rotor rotates and gyrates in response to fluid flow through the stator;

a housing, connected to the stator;

a bearing shaft, concentrically located within the housing, and rotatable about the longitudinal axis of the bearing shaft and the housing;

a bearing between the housing and the bearing shaft;

a flexible rod, extending between the rotor and the bearing shaft, for translating the rotation and gyration of the rotor to the true rotation of the bearing shaft;

an upper threaded connection, nonintegral to, but connected to one end of the rod, for connecting the rod to the rotor;

a lower threaded connection, nonintegral to, but connected to the other end of the rod, for connecting the rod to the bearing shaft;

a pair of splines, one on each of the connections; and a cylindrical overload sub, located concentrically around the rod, and having a slot on each end of the sub for engagement with the splines on the connections;

wherein the slots on the sub are wider than the splines on the connections, so that the connections can rotate axially a limited amount in relation to one another.

6. A downhole drilling motor, comprising:

a stator of the progressive cavity type;

a rotor, within the stator, wherein the rotor rotates and gyrates in response to fluid flow through the stator;

a housing, connected to the stator;

a bearing shaft, concentrically located within the housing, and rotatable about the longitudinal axis of the bearing shaft and the housing;

a bearing between the housing and the bearing shaft;

a flexible rod, extending between the rotor and the bearing shaft, for translating the rotation and gyration of the rotor to the true rotation of the bearing shaft;

an upper threaded connection, nonintegral to, but connected to one end of the rod, for connecting the rod to the rotor, the upper connection having a slot;

a lower threaded connection, nonintegral to, but connected to the other end of the rod, for connecting the rod to the bearing shaft, the lower connection having a slot;

a cylindrical overload sub, located concentrically around the rod; and a pair of splines, one on each end of the sub, for engagement with the slots on the connections;

wherein the slots on the connections are wider than the splines on the sub, so that the connections can rotate axially a limited amount in relation to one another.

7. A downhole drilling motor, comprising:

a stator of the progressive cavity type;

a rotor, within the stator, wherein the rotor rotates and gyrates in response to fluid flow through the stator;

a housing, connected to the stator;

a bearing shaft, concentrically located within the housing, and rotatable about the longitudinal axis of the bearing shaft and the housing;

a bearing between the housing and the bearing shaft;

a flexible rod, extending between the rotor and the bearing shaft, for translating the rotation and gyration of the rotor to the true rotation of the bearing shaft;

an upper threshold connection, nonintegral to, but connected to one end of the rod, for connecting the rod to the rotor, the upper connection having a plurality of splines and slots;

a lower threaded connection, nonintegral to, but connected to the other end of the rod, for connecting the rod to the bearing shaft, the lower connection having a plurality of splines and slots;

a cylindrical overload sub, located concentrically around the rod; and a plurality of splines and slots on each end of the sub, for engagement with the splines on the connections;

wherein the slots on the connections are wider than the splines on the sub, and the slots on the sub are wider than the splines on the connections, so that the connections can rotate axially a limited amount in relation to one another.

8. A downhole drilling motor, comprising:

a stator of the progressive cavity type;

a rotor, within the stator, wherein the rotor rotates and gyrates in response to fluid flow through the stator;

a housing, connected to the stator;

a bearing shaft, concentrically located within the housing, and rotatable about the longitudinal axis of the bearing shaft and the housing;

a bearing between the housing and the bearing shaft;

a flexible rod, extending between the rotor and the bearing shaft, for translating the rotation and gyration of the rotor to the true rotation of the bearing shaft;

an upper threaded connection, nonintegral to, but connected to one end of the rod, for connecting the rod to the rotor;

a lower threaded connection, nonintegral to, but connected to the other end of the rod, for connecting the rod to the bearing shaft;

a pair of splines, one on each of the connections; and a cylindrical overload sub, located concentrically around the rod, and having a slot on each end of the sub for engagement with the splines on the connections;

wherein the slot on one end of the sub is wider than the spline which that slot engages, and the slot on the other end of the sub is the same size as the spline which that slot engages, so that the connections can rotate axially a limited amount in relation to one another.

9. A downhole drilling motor, comprising:

a stator of the progressive cavity type;

a rotor, within the stator, wherein the rotor rotates and gyrates in response to fluid flow through the stator;

a housing, connected to the stator;

a bearing shaft, concentrically located within the housing, and rotatable about the longitudinal axis of the bearing shaft and the housing;

a bearing between the housing and the bearing shaft;

a flexible rod, extending between the rotor and the bearing shaft, for translating the rotation and gyration of the rotor to the true rotation of the bearing shaft;

an upper threaded connection, nonintegral to, but connected to one end of the rod, for connecting the rod to the rotor, the upper connection having a slot;

a lower threaded connection, nonintegral to, but connected to the other end of the rod, for connecting the rod to the bearing shaft, the lower connection having a slot;

a cylindrical overload sub, located concentrically around the rod; and a pair of splines, one on each end of the sub, for engagement with the slots on the connections;

wherein the slot on one of the connections is wider than the spline which that slot engages, and the slot on the other connection is the same size as the spline which that slot engages, so that the connections can rotate axially a limited amount in relation to one another.

10. A downhole drilling motor, comprising:

a stator of the progressive cavity type;

a rotor, within the stator, wherein the rotor rotates and gyrates in response to fluid flow through the stator;

a housing, connected to the stator;

a bearing shaft, concentrically located within the housing, and rotatable about the longitudinal axis of the bearing shaft and the housing;

a bearing between the housing and the bearing shaft;

a flexible rod, extending between the rotor and the bearing shaft, for translating the rotation and gyration of the rotor to the true rotation of the bearing shaft;

an upper threaded connection, nonintegral to, but connected to one end of the rod, for connecting the rod to the rotor, the upper connection having a plurality of splines and a plurality of slots;

a lower threaded connection, nonintegral to, but connected to the other end of the rod, for connecting the rod to the bearing shaft, the lower connection having a plurality of splines and a plurality of slots;

a cylindrical overload sub, located concentrically around the rod; and a plurality of splines on each end of the sub, for engagement with the splines on the connections;

wherein the slots on one of the connections are wider than the splines on that end of the sub, the slots on that end of the sub are wider than the splines on the connection at that end of the sub, and the splines and slots at the other end of the sub are the same size, so that the connections can rotate axially a limited amount in relation to one another.

* * * * *